US007832816B2

(12) United States Patent
Compagnucci

(10) Patent No.: US 7,832,816 B2
(45) Date of Patent: Nov. 16, 2010

(54) FRAME TO SUPPORT PULL-OUT AND ROTATING RACKS FOR CABINETS

(75) Inventor: Rossano Compagnucci, Osimo (IT)

(73) Assignee: Compagnucci Holding S.p.A., Santa Maria (AN) (IT)

( * ) Notice: Subject to any disclaimer, the term of this patent is extended or adjusted under 35 U.S.C. 154(b) by 308 days.

(21) Appl. No.: 11/988,957

(22) PCT Filed: Jun. 12, 2006

(86) PCT No.: PCT/IT2006/000439

§ 371 (c)(1),
(2), (4) Date: Jan. 17, 2008

(87) PCT Pub. No.: WO2007/000785

PCT Pub. Date: Jan. 4, 2007

(65) Prior Publication Data

US 2009/0267470 A1 Oct. 29, 2009

(30) Foreign Application Priority Data

Jun. 28, 2005 (IT) ..... AN050006 U

(51) Int. Cl.
*A47B 88/04* (2006.01)

(52) U.S. Cl. ..... 312/334.24; 312/322

(58) Field of Classification Search ..... 312/330.1, 312/334.1, 334.23, 334.24, 334.25, 334.26, 312/334.27, 334.28, 301, 302, 309, 310, 312/322

See application file for complete search history.

(56) References Cited

U.S. PATENT DOCUMENTS

| | | | | | |
|---|---|---|---|---|---|
| 1,010,950 | A * | 12/1911 | Prather | 312/123 |
| 2,650,871 | A * | 9/1953 | Holderegger | 312/322 |
| 4,984,854 | A * | 1/1991 | DeLavallade | 312/330.1 |
| 5,169,221 | A * | 12/1992 | Wheeler | 312/323 |
| 6,199,966 | B1 * | 3/2001 | Fulterer | 312/334.24 |
| 6,412,892 | B1 * | 7/2002 | Bonat | 312/334.47 |
| 6,682,159 | B2 * | 1/2004 | Compagnucci | 312/334.24 |
| 2002/0140329 | A1 * | 10/2002 | Compagnucci | 312/334.24 |
| 2004/0232810 | A1 * | 11/2004 | Kreyenkamp | 312/322 |

* cited by examiner

*Primary Examiner*—James O Hansen
(74) *Attorney, Agent, or Firm*—Hodes, Pessin & Katz, P.A.

(57) ABSTRACT

An improved frame to support pull-out and rotating racks for cabinets. The frame has a telescopic guide with a sliding end. The rack is prevented from accidentally rotating during pull-out.

3 Claims, 3 Drawing Sheets

FRAME TO SUPPORT PULL-OUT AND ROTATING RACKS FOR CABINETS

BACKGROUND OF THE INVENTION

The present application refers to an improved frame used to support pull-out and rotating racks, such as the ones commonly used in modern modular kitchen cabinets to support a series of shelves or baskets for food storage purposes.

A frame for racks of this type is disclosed in the Italian application for utility model MC 2004 U000004 filed by the same applicant.

The said application discloses a frame used to support racks that slide and rotate around a vertical axis, composed of a bearing rectangular structure formed of two uprights connected by two crosspieces, namely an upper and a lower crosspiece, respectively coupled to the sliding rod of two telescopic guides mounted on the bottom and top of the cabinet where the rack is to be contained.

The crosspieces are fixed to the sliding rods by means of vertical coaxial pins that allow the rack to rotate with respect to the sliding rods, which in turn allow the rack to be pulled out of the cabinet, whose door is mostly of translating, and not rotating, type, being normally frontally fixed to the front upright. By grabbing and pulling the door, the rack can be extracted and rotated by 90° to move the door laterally and give access to the shelves that are positioned laterally with respect to the user standing in front of the cabinet.

At least one of the crosspieces in the frame of the rack, preferably the lower crosspiece, is connected with the relevant telescopic guide by means of a special cover, which is fixed to the sliding rod of the guide in such a way that the cover only makes rectilinear alternate travels together with the sliding rod of the telescopic guides, while the rack is free to rotate with respect to the said cover.

In fact, the cover acts as support for the mechanisms used to guarantee the correct, safe movement of the rack.

More precisely, the said mechanisms are designed to prevent the rack from travelling backwards into the cabinet, until it is rotated leftwards o rightwards. The backward travel must be prevented until the frame of the rack resumes the initial pull-out position, when the crosspieces are perfectly parallel to the sliding rod of the telescopic guides.

To facilitate and accelerate perfect re-alignment between the crosspieces of the rack and the telescopic guides, the cover is provided with stops attached to corresponding snap-in means mounted on the crosspieces of the rack. This automatically determines the self-centring of the rack with respect to the telescopic guides when the user rotates the rack to place it in the correct position before pushing it inside the cabinet, after picking or storing the desired items.

Some problems have been encountered during the installation and use of the said kitchen cabinets equipped with the above pull-out and rotating racks of known type, and the present invention is intended to provide a solution to these problems.

The first problem consists in the fact that, when pulling-out the rack, the rack can accidentally rotate before the forward travel is completed, thus making the shelves of the rack touch and rub the sides of the cabinet.

As a matter of fact, the only means that are currently available to prevent this inconvenience are the self-centring means of the rack, which are snap-type means, since they need to be released from the crosspieces of the rack when the rack is pushed into rotation at the end of the pull-out travel.

This means that, if accidental transversal forces cause the rotation of the rack during the pull-out travel, the rack starts rotating as soon as the modest resistance offered by the snap-in self-centring means is overcome.

The second inconvenience occurs during the installation of the rack, when the door must be regulated to perfectly touch the four sides of the cabinet. In such a case, regulation is limited by the fact that the door is fixed directly to the front upright of the bearing rectangular structure, whose crosspieces are directly attached to the sliding rod of the telescopic guides by means of the two vertical coaxial pins that are subject to stress in case of regulation.

BRIEF SUMMARY OF THE INVENTION

The main purpose of the present invention is to provide an improved frame used to support pull-out and rotating racks for cabinets, which comprises guiding means able prevent the rack from accidentally rotating during pull-out, it being provided that these guiding means have no effect when the rack reaches the end of the pull-out travel.

A further purpose of the present invention is to provide an improved type of frame used to support pull-out and rotating racks, able to facilitate and accelerate the installation of the rack, while also increasing the regulation range for the position of the rack.

The aforementioned purposes have been achieved by the improved frame of the invention, whose characteristics are illustrated in detail in the first claim. The improved frame of the invention comprises a boxed guiding track, with U-shaped cross-section, which houses one of the two telescopic guides, the special cover and one of the two crosspieces of the rack.

The guiding track is designed to be permanently and directly fixed on the bottom or top of the cabinet, becoming a fixing element for the telescopic guide associated with it.

The height of the borders of the guiding track is such that they are positioned close to the crosspiece of the rack contained in the track.

The length of the borders of the guiding track is such that the close position only ends when the rack has reached the end of the pull-out travel.

This means that the crosspiece is physically prevented from departing laterally until the rack is not pulled-out completely, since the crosspiece exactly slides inside the guiding track that is rigidly fixed to the cabinet.

The improved frame of the invention also comprises an opposite pair of boxed bars, namely one lower bar and one upper bar, centrally fixed to the sliding rod of the two telescopic guides by means of the opposite coaxial pair of vertical pins, around which the rack rotates.

The said boxed bars make horizontal alternate travels, together with the sliding rods of the telescopic guides, and at the same time are free to rotate with respect to their pivoting rods, more precisely around a vertical axis that passes through the opposite coaxial pair of pins.

The boxed bars are suitably dimensioned to be exactly housed in the crosspieces of the bearing rectangular frame, which is fixed inside the housing bar by means of a pair of transversal screws inserted through a corresponding pair of slots suitably provided on the border of the bar.

The slots are used to adjust the position of the rack with respect to the bars and indirectly with respect to the telescopic guides to which the bars are coupled.

The pre-assembled rack between the opposite pair of the two boxed bars, can be easily and rapidly installed after permanently fixing the telescopic guides inside the cabinet.

BRIEF DESCRIPTION OF SEVERAL VIEWS OF THE DRAWINGS

For purposes of clarity the description of the device of the improved frame of the invention continues with reference to the enclosed drawings, which are intended for purposes of illustration only and not in a limiting sense, whereby:—

DETAILED DESCRIPTION OF THE INVENTION

Figure 1:
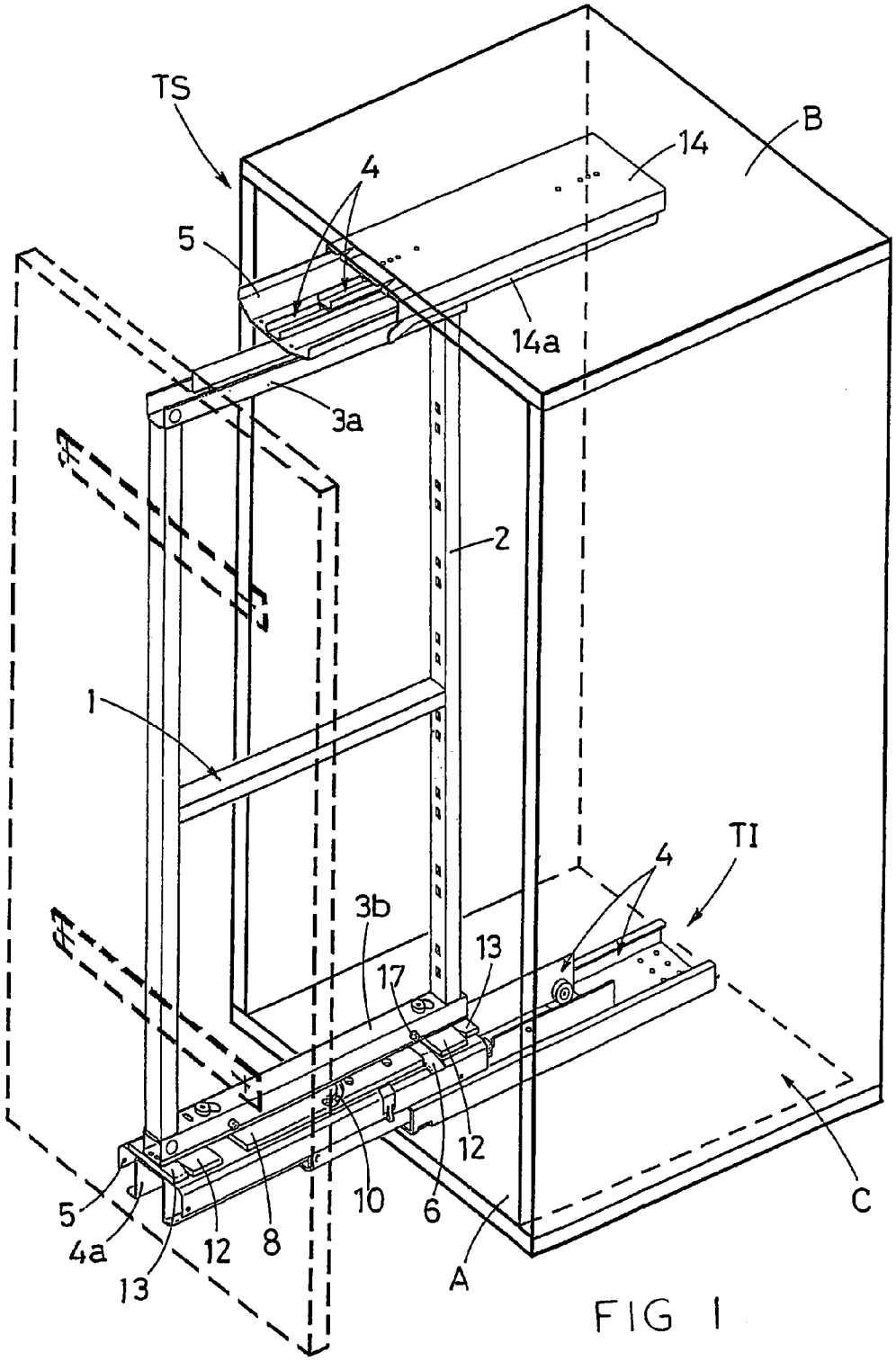
FIG. 1 is a diagrammatic axonometric view of a cabinet equipped with a pull-out rotating rack supported by the improved frame of the invention.
Figure 2:
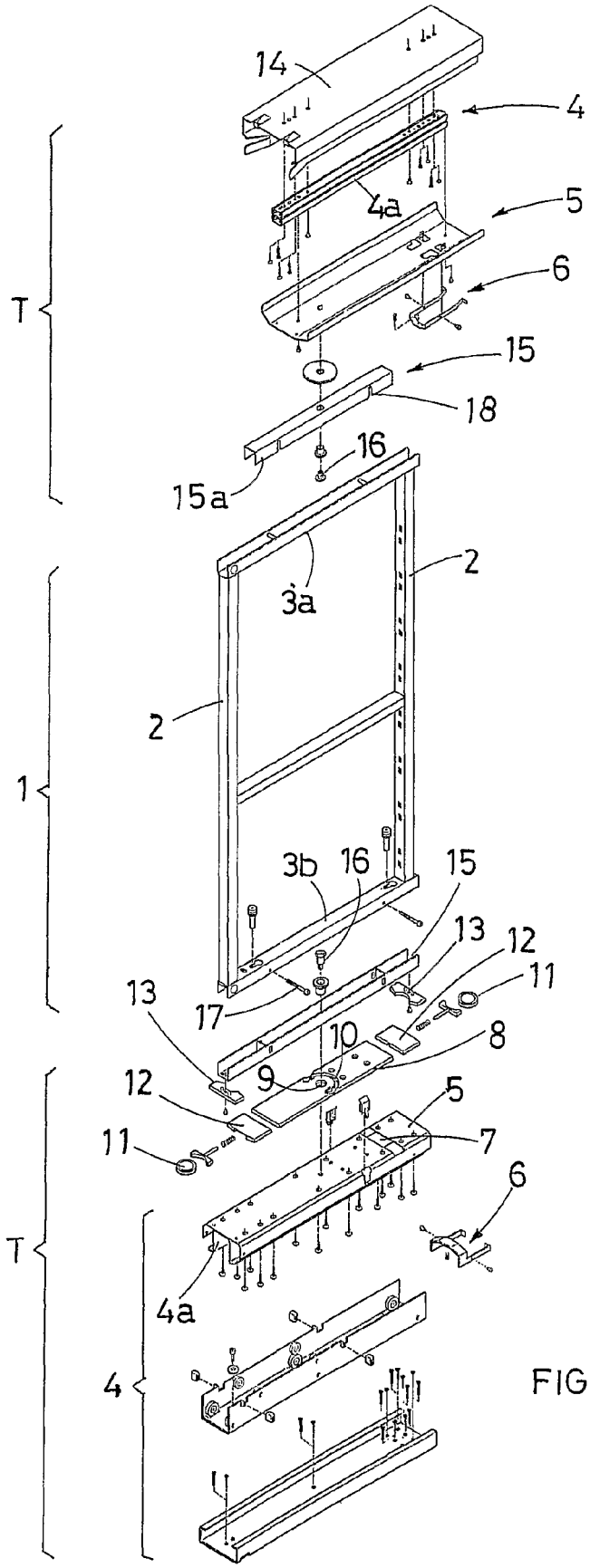
FIG. 2 is an exploded axonometric view of the improved frame of the invention and the structure of the rack associated with it.
Figure 3:
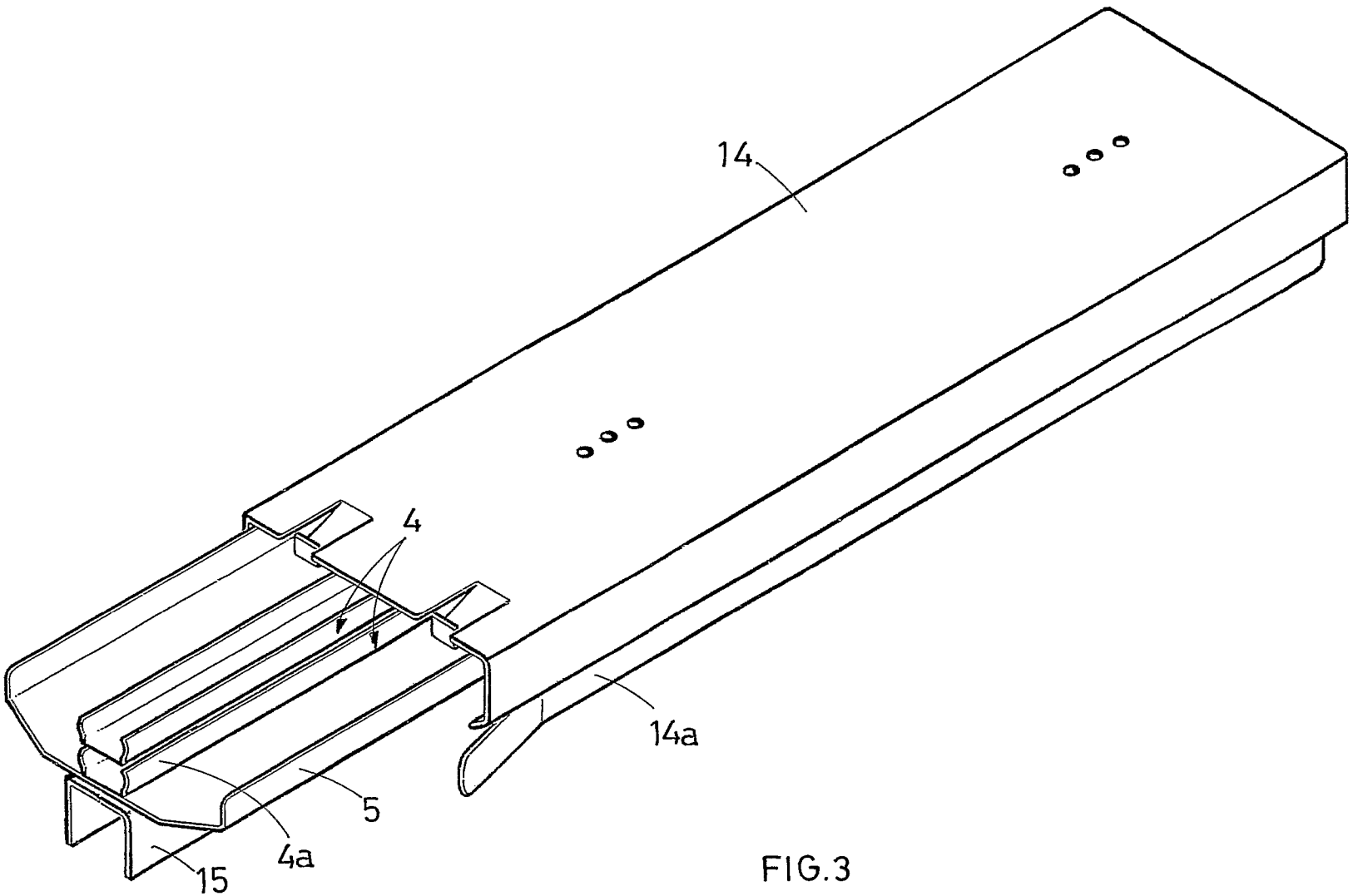
FIG. 3 is an axonometric view of the guiding track for the alternate travels of the rack.

With reference to the aforementioned figures, the improved frame (T) is designed to support a rack (1) that slides and rotates around a vertical axis, which is composed of a bearing rectangular structure formed of two uprights (2) connected by two crosspieces, in upper (3*a*) and lower (3*b*) position, respectively coupled to the sliding rod (4*a*) of two telescopic guides (4) mounted on the bottom (A) and top (B) of the cabinet (C) where the rack (1) is to be contained.

The frame (T) is composed of a lower semi-frame (TI) fixed on the bottom (A) and an upper semi-frame (TS) fixed to the top (B) of the cabinet.

In both semi-frames (TI and TS) the frame (T) comprises a special cover (5) designed to be fixed to the sliding rod (4*a*) of the telescopic guides (4) to support the mechanisms used to guarantee the correct, safe movement of the rack, which are already known and disclosed in the aforementioned application for utility model MC 2004 U000004.

More precisely, the said mechanisms comprise a lever (6) pivoted inside a slot (7) in the cover (5) and designed to prevent the rack (1) from travelling backwards into the cabinet until it is rotated leftwards o rightwards.

The said mechanisms also comprise a plate (8) fixed to the cover (5) and provided with a central hole (9) with respect to the vertical rotation axis of the rack (1); the plate (8) is also provided with a semi circumference arch-shaped slot (10) in which a vertical pin (non shown) is inserted and slides, rotating with the rack (1) and acting as stop at the end of the rotation travel.

Finally, the mechanisms comprise a pair of small wheels (11) that idle around a vertical axis and are partially contained and sliding in corresponding support brackets (12) fixed at the two ends of the cover (5), in such a way that the small wheels (11) engage with corresponding stop and self-centring jaws (13), which rotate with the frame (T).

In the preferred embodiment of the frame (T), the plate (8) and the brackets (12) are only provided in the lower semi-frame (TI).

The peculiarity of the improved frame (T) of the invention consists in the fact that it comprises at least a boxed guiding track (14), with U-shaped cross-section, which houses one of the two telescopic guides (4), the special cover (5) and one crosspiece (3*a* or 3*b*) of the bearing structure of the rack (1).

The guiding track (14) is designed to be permanently and directly fixed on the bottom (A) and/or top (B) of the cabinet (C), becoming a fixing element for the telescopic guide (4) associated with it; in the preferred embodiment of the invention the track (14) is only incorporated into the upper semi-frame (TS).

The height of the borders (14*a*) of the guiding track (14) is such that they are positioned close to the crosspiece (3*a* or 3*b*) of the rack (1).

The length of the borders (14*a*) of the guiding track (14) is such that the close position only ends when the rack (1) has reached the end of the pull-out travel.

Another peculiarity of the improved frame (T) consists in the fact that it comprises an opposite pair of boxed bars (15), in upper and lower position, centrally fixed to the sliding rod (4*a*) of the two telescopic guides (4) by means of corresponding opposite coaxial pins (16), around which the rack (1) rotates.

The said boxed bars (15) make horizontal alternate travels, together with the sliding rods (4*a*) of the telescopic guides (4), and at the same time are free to rotate with respect to their pivoting rods, more precisely around a vertical axis that passes through the opposite coaxial pair of pins (16).

Attention is drawn on the fact that the cover (5) is located in intermediate position between the boxed bar (15) and the telescopic guide (4), since the cover (5) is rigidly fixed to the sliding rod (4*a*) of the telescopic guide (4), while the bar (15) is pivoted to the rod (4*a*) by means of a pin (16).

The boxed bars (15) are suitably dimensioned to be exactly housed in the crosspieces (3*a* and 3*b*) of the rack (1), which can be fixed inside the bar (15) by means of a pair of transversal screws (17) inserted through a corresponding pair of slots (18) suitably provided on the edges (15*a*) of the bars (15).

The slots (18) permit the regulation of the rack (1) without stressing the pivoting pins (16).

Finally, it must be noted that the frame (T) of the invention can be supplied to the final user in pre-assembled configuration, meaning that each bar (15) can be pre-assembled with the corresponding pin (16), cover (7) and mechanisms (8, 10, 13, 14), as well as with the telescopic guide (4), leaving the user the task to fix the guiding track (14) inside the cabinet.

The invention claimed is:

1. An improved frame used to support pull-out and rotating racks for cabinets, of the type composed of:

a cabinet (C) having a bottom (A) and a top (B), a rack (1) having a bearing structure with a crosspiece (3*a* or 3*b*), a lower semi-frame (TI) and an upper semi-frame (TS), a telescopic guide (4) with a sliding rod (4*a*), a cover (5) fixed to the sliding rod (4*a*) of the telescopic guide (4), and supporting mechanisms (6, 8, 10, 11, 12, 13) that guarantee a correct, safe movement of the rack, at least one boxed track (14), with U-shaped cross-section, which houses the telescopic guide (4), the cover (5) and the crosspiece (3*a* or 3*b*) of the bearing structure of the rack (1);

the boxed track (14) having borders (14*a*), said boxed track suitable to be fixed on the bottom (A) or top (B) of the cabinet (C), the borders (14*a*) of said boxed track (14) being positioned, due to their height, close to the crosspiece (3*a* or 3*b*) of the rack (1), when the rack (1) is partially inserted or non completely pulled-out, said borders (14*a*) of the boxed track (14) being no more close to the crosspiece (3*a* or 3*b*) of the rack (1), when the rack (1) is completely pulled-out, wherein the supporting mechanisms used to guarantee the correct, safe movement of the rack (1) comprise a pair of small wheels (11) that idle around a vertical axis and are partially contained and sliding in corresponding support brackets (12) fixed at the two ends of the cover (5), in such a way that the small wheels (11) snap-in with corresponding stop and self-centering jaws (13), which rotate with the frame (1).

2. An improved frame as defined in claim 1, characterized in that the rack (1) has a vertical rotation axis, and the supporting mechanisms used to guarantee the correct, safe movement of the rack (1) further comprise a plate (8) fixed to the cover (5) and provided with a central hole (9) with respect to the vertical rotation axis of the rack (1); the plate (8) being also provided with a semi circumference arch-shaped slot (10).

3. An improved frame as defined in claim 1, characterized in that the supporting mechanisms used to guarantee the correct, safe movement of the rack (1) further comprise a lever (6) pivoted inside a slot (7) in the cover (5), designed to prevent the rack (1) from traveling backwards into the cabinet until the rack (1) is rotated leftwards or rightwards.

* * * * *